US005438814A

United States Patent [19]

Lovett et al.

[11] Patent Number: 5,438,814

[45] Date of Patent: Aug. 8, 1995

[54] BUCKET LIDDING SYSTEM FOR CONTINUOUSLY CONVEYING BUCKETS

[75] Inventors: David E. Lovett; Richard O'Brien, both of Indianapolis, Ind.

[73] Assignee: Webber Manufacturing Co., Inc., Indianapolis, Ind.

[21] Appl. No.: 125,111

[22] Filed: Sep. 21, 1993

[51] Int. Cl.[6] ..... B65B 7/28

[52] U.S. Cl. ..... 53/75; 53/282; 53/367; 53/489; 53/505

[58] Field of Search ..... 53/75, 76, 69, 68, 64, 53/505, 506, 367, 304, 312, 282, 287, 133.2, 489, 485

[56] References Cited

U.S. PATENT DOCUMENTS

| | | | |
|---|---|---|---|
| 1,912,677 | 6/1933 | Williams . | |
| 2,082,048 | 6/1937 | Everett | 226/88.1 |
| 2,762,177 | 9/1956 | Magnesen | 53/128 |
| 2,862,340 | 12/1958 | Rauli | 53/287 |
| 3,054,240 | 9/1962 | Dimond | 53/367 X |
| 3,264,795 | 8/1966 | Bauer | 53/128 |
| 3,282,025 | 11/1966 | Amberg et al. | 53/282 X |
| 3,540,181 | 11/1970 | Bowen | 53/367 X |
| 4,098,059 | 7/1978 | Chattillion | 53/319 |
| 4,285,187 | 8/1981 | Schjeldahl | 53/282 |
| 4,312,172 | 1/1982 | Fisher et al. | 53/489 |
| 4,683,706 | 8/1987 | Harper | 53/367 X |
| 5,048,259 | 9/1991 | Cox et al. | 53/132.1 |
| 5,050,367 | 9/1991 | Heisler | 53/367 X |
| 5,095,681 | 3/1992 | Choi | 53/306 |
| 5,123,229 | 6/1992 | Dardaine et al. | 53/426 |

*Primary Examiner*—James F. Coan

*Attorney, Agent, or Firm*—Ice Miller Donadio & Ryan; Paul B. Overhauser; Doreen J. Gridley

[57] ABSTRACT

A bucket lidding system for placing rotationally oriented lids on unlidded buckets being conveyed on a conveyor and subsequently seating the lids onto the buckets. A lid conveyer introduces to the system a vertical stack of bucket lids wherein each lid has a fitting. After the entire stack of bucket lids is raised such that a top lid of the stack is positioned at a selected height, a mechanism lifts and holds the top lid and transports that lid to a position over another conveyer where a lidless bucket is being conveyed. During this lid transportation, the held lid is being rotated under a fitting sensing sensor, which instructs the lid rotation to be stopped when the lid has a desired rotational orientation with respect to the lidless bucket. When a sensor senses the bucket on the bucket conveyer means, the oriented lid is released and drops a short distance onto the bucket. The bucket with the unseated lid then continues on the conveyor in the system and passes beneath a lid press plate, which is driven downward to thereby seat the lid on the bucket. The press plate is designed to move along the conveyer at a speed approximately equal to the bucket speed such that during lid seating the bucket need not be stopped.

31 Claims, 8 Drawing Sheets

BUCKET LIDDING SYSTEM FOR CONTINUOUSLY CONVEYING BUCKETS

FIELD OF THE INVENTION

This invention relates to bucket lidding systems, and, in particular, to a bucket lidding system which first places a bucket lid onto a lidless bucket moving through the system and then seats the lid onto the bucket.

BACKGROUND OF THE INVENTION

A wide assortment of products, including paints and chemical solutions, can be distributed in containers such as buckets or pails. These containers normally have lids which must be secured thereon to prevent the products introduced therein from spilling out. Normally, the lid securing process is a two step process, wherein a lid is first placed loosely onto a bucket and secondly seated on the bucket. A complication associated with lid securement in many situations pertains to a fitting, or in other words a pour spout or opening, on a lid. To facilitate the carrying and emptying of the contents of a bucket, a handle is usually provided. Because the fitting should be located 90° away from each end or lobe of the handle in order to allow the bucket contents to be poured out in the easiest and least messy manner, a lid must be properly oriented when it is placed on the bucket for seating.

Efforts by manufacturers to loosely place the lids on the buckets prior to lid seating have taken many forms. A person can manually orient a lid, i.e. rotate the lid until the fitting is in the proper location relative to the handle of a bucket passing on a conveyer by the person, and then place the lid on a bucket. In addition to being labor intensive, this process can be slow compared to automation.

Machine bucket lidding systems which perform this repetitious lid placement function have been available on the market. One type of system utilizes a vertically stacked supply of lids which are positioned above a conveyer whereon lidless buckets are being conveyed. In operation, a lid is automatically removed from the bottom of the stack and released into a chute. The lid slides down the chute until it is stopped at a location wherein the substantially horizontal lid extends beyond the end of the chute and directly above the conveyer. A conveyed lidless bucket contacts the skirt of the lid and drags the lid out from the chute such that the lid drops down onto the bucket. This system is not preferred because, for example, no means of properly orienting a lid with a fitting prior to placement on the bucket is provided, introducing stacks of lids above the conveyer at a relatively high height can be inconvenient to load and possibly require either machinery to raise the stacks of lids or that the lids be loaded at a higher building floor, the weight of the other lids in the stack may make removing the bottom lid more difficult, and lids having shorter skirts are incompatible with the system.

Another prior art lid placement system utilizes a supply of stacked lids also positioned entirely above a passing conveyer device. Each lid in the stack is substantially vertical, as the stack is either horizontally disposed or slightly sloped. In operation, the lid from the bottom of the stack is first pulled from the stack and rotated next to a mechanical switch. The switch, which is situated to contact and thereby examine the bottom of the lid, allows for a selected orientation of the lid prior to placement on a bucket. As a bucket passes underneath the substantially vertically disposed lid, the lid is pivoted on its bottom most side such that under gravity it drops down onto the passing bucket. While this system does provide an orientation function, the way the lid is pivotally dropped onto the bucket results in the possibility that the lid will rotate as it drops onto the pail and therefore the fitting will not be sufficiently precisely aligned.

Another device which places lids, although onto barrels rather than buckets, is U.S. Pat. No. 5,048,259. Because it does not provide for the rotational orientation of the lid before placement on a standard barrel, this device has very limited if not no application in operations where lids with fittings are being secured. The device in U.S. Pat. No. 2,762,177 functions to place lids onto buckets. However, because no fittings are disclosed as present in the lids, this device also fails to teach a rotational orientation of the lids.

After the physical placement of a bucket lid onto the top of a filled bucket, a manufacturer must then seat the lid onto the bucket. For most lid and bucket assemblies, the seating of the lid results from the engagement of a locking mechanism between the lid and the bucket. For instance, within a bucket top edge receiving groove of the lid defined by the lid skirt and a more inner lid lip, a lid has a locking member which projects from the lid skirt into this groove. The bucket top edge has an extending circumferential lip. The locking engagement is achieved by forcefully pressing the lid downward onto the bucket, whereby the lid locking member snaps tightly over the bucket lip and engages the lip underside to prevent the lid from being lifted off the bucket. This locking engagement can be made so secure that only in destroying the lid is the lid removable from the bucket.

As with lid placement, lid seating in some circumstances can be performed entirely manually. However, this process suffers from similar shortcomings to those associated with manual lid placement.

A mechanical roller device is currently used in some bucket lidding systems to provide for this seating function. The roller device, positioned over a conveyer type device on which buckets with lids loosely placed thereon are conveyed, comprises a series of rollers all disposed transverse to the travel path of the buckets. The roller device, taken as a single unit, is slightly sloped downward relative to the conveyer. This slope is a consequence of each roller being at a slightly lower height than the preceding roller immediately upstream the conveyer path. When a bucket passes beneath the roller device, the bucket lid encounters progressively lower rollers and is seated on the bucket by the time it exits from the roller device. These roller type devices allow a lid to be seated without ever requiring the bucket be stopped. This continuous bucket motion is very important, both in the lid placement and lid seating processes, as stopping moving buckets causes the contents to tidal wave or slosh around and potentially spill over the bucket top. With buckets holding corrosive materials or other harmful products, spilling may be dangerous and is highly undesirable. However, not all lids can be adequately seated by these devices.

Some lids require a significant amount of force to be seated properly, and roller devices do not always perform satisfactorily. For instance, in order to meet UN specifications by passing demanding tests such as compression tests and droppage tests, lid and bucket assemblies must be constructed very strong and durable. As a result, a large amount of downward force must be applied to a lid in order to seat it on the bucket. In many cases, to secure these types of lids it is necessary to stop the conveyer or remove the bucket therefrom in order to use a stationary lid press to seat the bucket lid. However, this bucket stoppage is undesirable as it slows down a production line and may result in the bucket contents sloshing over the sides, potentially harming both the machine and its operator.

Several devices in the art, such as those disclosed in U.S. Pat. Nos. 2,762,177, 2,862,340, and 3,264,795, all function to seat lids on buckets. However, each of these devices suffers from the same shortcomings of requiring the bucket be stopped during the seating of the bucket lid.

OBJECTS OF THE INVENTION

One object of the present invention is to provide a bucket lidding system which rotationally orients a lid and then vertically drops the lid a small distance onto a continuously moving bucket, thereby increasing the likelihood that the lid orientation is maintained during placement.

Another object of the present invention is to provide a bucket lidding system which uses a sensor, situated above the lid to be placed, to sense the orientation of a lid for placement by identifying a fitting without mechanically contacting the lid.

Another object of the present invention is to provide a bucket lidding system which places a lid from the top of a stack of lids onto a passing bucket, thereby making easier the introduction of lids into the system.

It is still another object of the present invention to provide a bucket lidding system which seats a lid onto a bucket being continuously conveyed on a conveyer.

It is still another object of the present invention to provide a bucket lidding system which applies downward force sufficiently large to seat a UN specification type lid onto a same type bucket without requiring the bucket be stopped for the lid seating.

SUMMARY OF THE INVENTION

In one form thereof, the bucket lidding system of the present invention includes a conveyer for moving a bucket with an unseated lid thereon, a lid press plate, and a mechanism for moving the lid press plate. The conveyer means defines a bucket travel path and a bucket travel speed and serves to move a bucket in a first direction along the travel path. The mechanism for moving the lid press plate includes means for moving the lid press plate in the first direction along the bucket travel path at a speed approximately equal to the bucket travel speed during lid seating and means for moving the lid press plate downward from a height above the unseated bucket lid to thereby seat the lid on the bucket. After the lid seating is complete, the mechanism for moving the lid press plate moves the plate both upward and along the bucket travel path in a direction opposite the first direction to prepare the bucket lidding system for the next bucket introduced into the system requiring seating of a lid.

In another form thereof, the bucket lidding system of the present invention includes conveyer means for moving a lidless bucket, means for lifting a top lid from a stack of bucket lids, means for transporting the lifted lid to a position over the conveyer means, and means for sensing the bucket on the conveyer means. The sensing means is operably connected to means for releasing the lifted lid such that at an appropriate time after the bucket is sensed the releasing means release the lifted lid and the force of gravity is utilized to thereby place the lid onto the bucket.

In another form thereof, the bucket lidding system of the present invention places a lid having a fitting onto a bucket and includes means for holding and releasing the lid, means for rotating the held lid prior to releasing the lid, means for sensing the lid fitting without mechanically contacting the lid, and means responsive to the sensing means for stopping rotation of the held lid. The lid fitting sensing means is preferably a photosensor positioned above the held lid.

In another form thereof, the bucket lidding system of the present invention places a lid and includes means for holding the lid, means for concurrently rotating and transporting the lid held by the holding means, and means for releasing the lid from the holding means onto a bucket. The lid holding means employs at least one suction means such as a suction cup.

In still another embodiment thereof, the bucket lidding system of the present invention includes conveyer means for selectively moving a vertical stack of bucket lids wherein the lids in the stack each have a fitting, conveyer means for moving a lidless bucket, means for raising from the lid stack conveyor means the entire stack of bucket lids such that a top lid of the stack is positioned at a selected height, means for lifting and holding the top lid from the raised stack of bucket lids, means for concurrently rotating the held lid and transporting the held lid to a position over the lidless bucket conveyer means, means for sensing the lid fitting of the rotating held lid, means responsive to the lid fitting sensing means for stopping rotation of the held lid whereby the lid has a selected rotational orientation with respect to the bucket on the lidless bucket conveyer means, means for releasing the lid from the holding means, and means for sensing the bucket on the lidless bucket conveyer means, the bucket sensing means being operably connected to the lid releasing means to thereby place the lid onto the conveying bucket.

DETAILED DESCRIPTION

Figure 1:
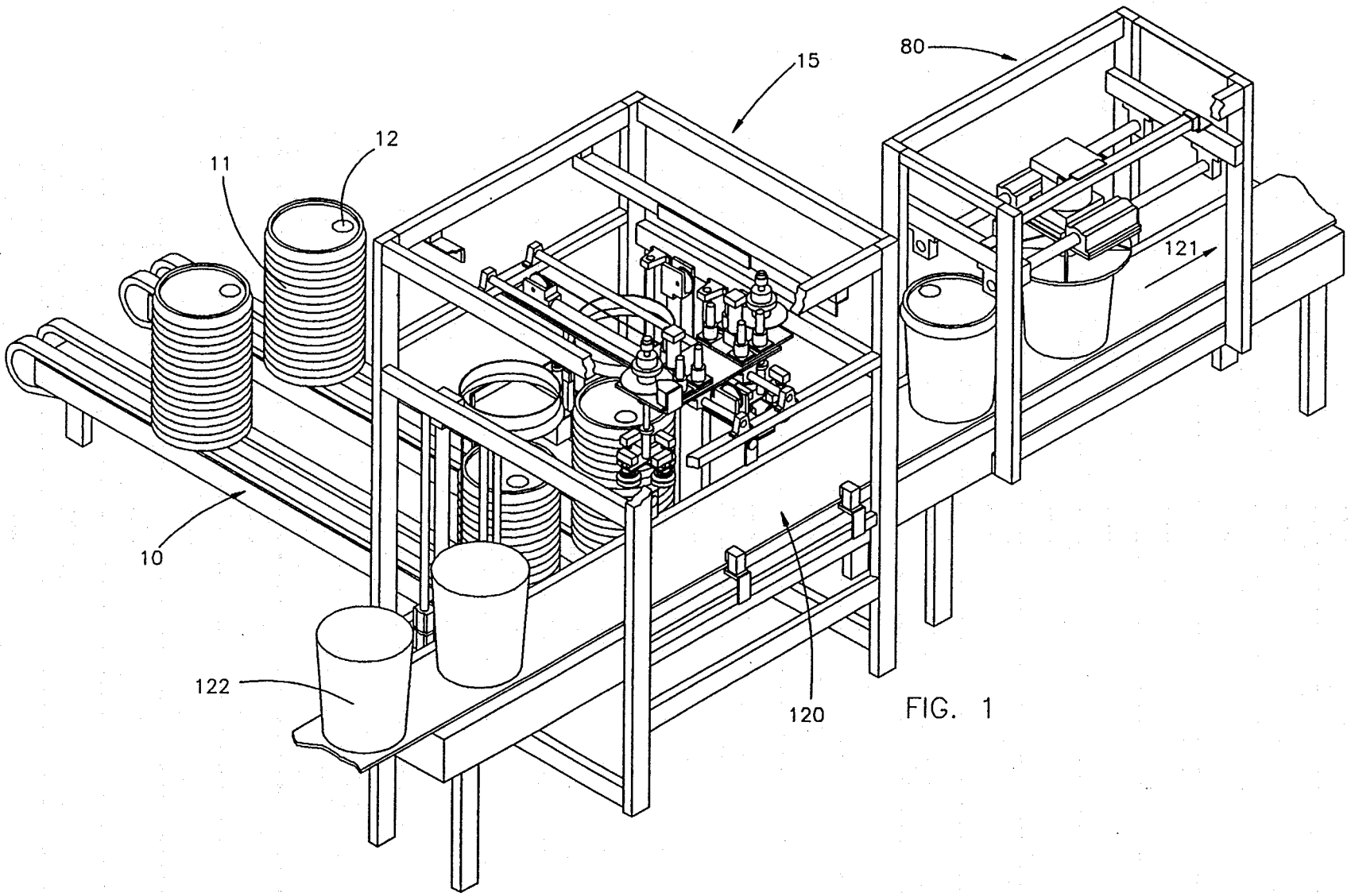
FIG. 1 shows a diagrammatic perspective view of one embodiment of the bucket lidding system of the present invention with associated conveyors conveying buckets and stacks of lids.

Referring to FIG. 1, there is shown a perspective view of the bucket lidding system of the present invention. The system utilizes a lid orienter and placer, generally designated 15, to place properly oriented lids on unlidded buckets 122 being conveyed or transported on a pail conveyer, generally designated 120. A traveling lid press, generally designated 80, is disposed further downstream than lid placer 15 along bucket conveyer 120 and is utilized to seat the lids loosely placed on the buckets by lid placer 15. Although in FIG. 1 lid placer 15 and lid press 80 are shown separated by a finite length of bucket conveyer 120, this spacing is solely for purposes of illustration herein. In practice, the complementary units of the bucket lidding system will likely be installed adjoining to conserve valuable work plant floor space.

Bucket conveyer 120 includes a stationary frame 125 as well as a traveling or moving belt member 126. Bucket conveyer 120 is a continuously cycling or conveying device which, as shown in FIG. 1, passes through and generally under both lid placer 15 and traveling lid press 80. Individual unlidded buckets are placed on the upstream end of bucket conveyer 120 either manually or mechanically. In addition, in order to capitalize on the lid orienting function provided by lid placer 15, these individual buckets must each be positioned on conveyer 120 such that their handles each manifest a selected orientation when the buckets pass under lid placer 15. Otherwise, if the buckets are randomly rotationally oriented, placing rotationally oriented lids thereon yields random lid orientations relative to the buckets. If lid placer 15 is employed to place lids without fittings, it will be appreciated that the unlidded buckets then need not be oriented prior to lid placement. Moving belt member 126 is constructed from rigid metal slats disposed transverse to the direction of travel. These metal slats are employed as they are sufficiently strong to withstand the large amounts of force being applied thereto during the seating of the bucket lids in traveling lid press 80. Other types of conveyers, including rollers, are not precluded from use with the present system provided these conveyers be constructed strong enough to not deform under the forces experienced during the bucket lid seating process. In operation, bucket conveyer 120 is continuously moving at a constant speed in the direction indicated by arrow 121. As a result of the conveying of buckets thereon, moving conveyer 120 defines the travel path and travel speed of the buckets being lidded.

FIG. 1 discloses a pair of parallel lid conveyers, generally designated 10, at substantially ground level on which vertical stacks of lids 11 are placed. Lid conveyers 10 each include stationary frame 145 and moving chain members 146. Each lid in each vertical stack 11 includes a fitting or opening 12 as shown in those lids on the top of stacks 11. Unlike bucket conveyer 120, lid conveyers 10 are not in constant motion, but rather are operatively connected with lid placer 15, as more fully described below, to introduce stacks of lids 11 thereto selectively.

Figure 2:
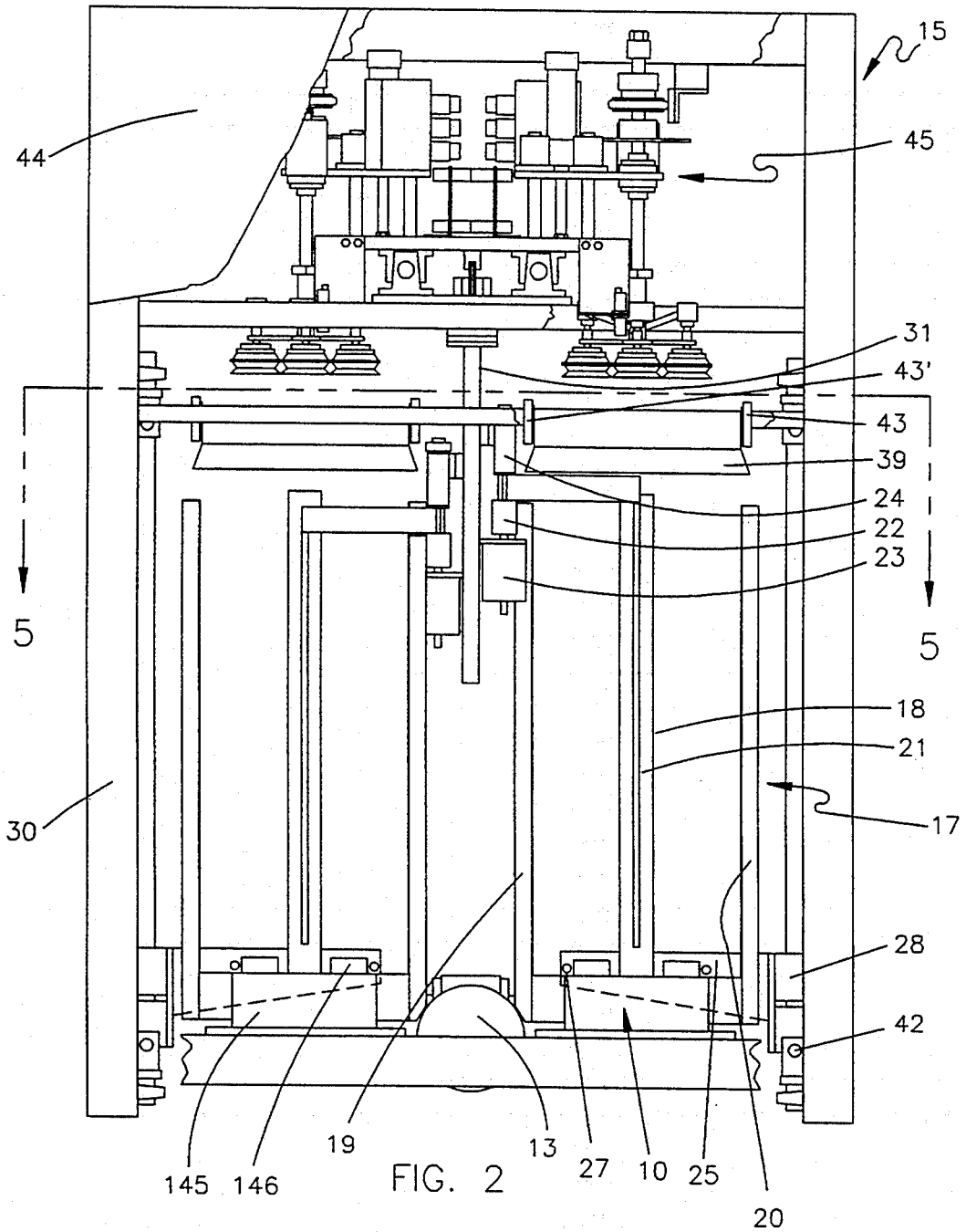
FIG. 2 shows an end view of the lid orienter and placer of FIG. 1, the view being taken of the end where stacks of lids are introduced, wherein portions of the device are removed for illustration purposes.

The lid placer of the present invention shown in FIGS. 2–6 is a double lid placer having two levelator mechanisms 17 and essentially two lid rotator and transporter mechanisms 45. Thus, the shown embodiment allows two stacks of lids to be individually raised, and then the top lid from each stack can be separately picked up, transported and rotationally oriented, and placed onto separate buckets. Although each of these operations are not necessarily performed synchronously by the two placers, they do occur at approximately the same time. As best shown in FIG. 2, the configurations of the components of each placer are similar to the other placer. Therefore, the teachings herein as to the construction and workings of one placer of the double lid placer shown have equal application to the other placer. Furthermore, while a double lid placer is shown, it will be appreciated that a single lid placer or a greater number of lid placers, as long as certain conditions such as a proper rate of bucket introduction are satisfied, can utilize the teachings of the invention.

Referring now to FIGS. 2–5, stack of lids 11 is initially loaded into lid placer 15 by being received by the levelator, generally designated 17. Levelator 17 is positioned proximate the drop-off end of lid conveyers 10 and includes a vertical, forward situated lid guide bar 18 slightly beyond the conveyer end. A pair of opposing, vertical, side situated lid guide walls 19, 20 flank lid conveyers 10 near its end to prevent the lid stacks from toppling over sideways. Guide walls 19, 20 are attached to conveyer frame 145, as shown in FIG. 2, at a point upstream conveyer 10 that resides outside lid placer 15. As shown conceptually in FIG. 5, a guide bar or stack straightener 21 can be pivoted from a retracted position at the side or not above lid conveyer 10 to a position directly above conveyer 10 to enclose with guide bar and walls 18–20 a stack of lids 11, shown in shadow, conveyed to the end of lid conveyers 10. Stack straightener 21 is selectively rotated via coupling 22 by air operated rotary actuator 23, and is ultimately connected to lid placer support frame 30 through means including bearing column 24 and stationary support bar 31. Support frame 30 is preferably constructed of hollow rectangular steel bars welded together in an overall parallelepiped shape. Photoeye sensor 40 is attached to support frame 30, positioned along the side of conveyer 10, and aligned to sense stacks of lids 11 on conveyer 10. Plexiglass shield 44 preferably covers all the top, ends, and side surfaces of lid placer 15 except for those surface areas which require an opening to receive either stacks of lids 11 or the buckets on conveyer 120.

The portion of levelator 17 which actually contacts and lifts stack of lids 11 during the raising is an L-shaped (see FIG. 4) lifter frame 25 having a triangular reinforcing rib 26 and a pair of horizontal prongs 27 welded thereto. Prongs 27 are sized and positioned to flank the sides of lid conveyers 10 with enough clearance therebetween to be raised vertically without contacting the conveyer. Two sets of pillow blocks 28, brake caliper 35, and cable attachment extension 34 are welded to the outside of the outer leg of lifter frame 25. Pillow blocks 28 have vertically oriented bores which slidably receive guide shafts 33, which extend to the top of levelator 17 near centering hoop 39. Brake caliper 35 receives braking bar 36, which also extends to the top of levelator 17 and which can be engaged by caliper 35 to stop the vertical motion of lifter frame 25. The power to elevate lifter frame 25 is provided by pneumatic cable cylinder 37, which is pneumatically connected with a high pressure source of air through a directional control valve not shown. Pneumatic cable cylinder 37 extends to the top of levelator 17, and its cables 38 connect to lifter frame 25 via cable attachment extension 34. It will be appreciated that when cylinder 37 is operated and its internal piston is shifted in a first direction, lifter frame 25 shifts a corresponding amount vertically in an opposite direction along the path defined by guide shafts 33.

Suspended above the end of lid conveyer 10 and proximate the top of levelator 17 is centering hoop 39. Notches in hoop 39 which start at the underside and extend upward receive prongs 27 of lifter frame 25 so as not to interfere with the raising of the bottom lid of stack 11 once all the lids previously on top of this lid have been removed and placed. Proximity switch 41, positioned at the top of levelator 17, and proximity switch 42, positioned at the bottom of levelator 14, respectively determine when lifter frame 25 has reached the upper end and lower end of its travel. Photoeye sensors 43, 43' are located at the top of centering hoop 39 and are aligned to sense when the top of the stack of lids 11 being raised has been elevated to the proper height. Photoeye sensors 43, 43' function by sensing when a beam of light therebetween is broken by the top lid in the stack.

Levelator 17 of lid placer 15 operates as follows. When proximity switch 42 at the bottom of levelator 17 identifies the presence of a pillow block 28 of lifter frame 25, conveyer motor 13 is activated and lid conveyer 10 begins to move, carrying the stacks of lids 11 placed thereon forward toward the placer. As lid conveyer 10 continues to move, the most forward stack soon passes into the volume defined by support frame 30 and is identified by sensor 40, at which time motor 13 is signalled to stop running after an established time has passed such that stack of lids 11 is conveyed to a position directly below centering hoop 39. Stack straightener 21, which during this stack conveyance was positioned in the retracted position, is then rotated inward to ensure stack of lids 11 remains fairly upright during subsequent lifting or raising. In order to position the top lid of stack 11 at a proper height to allow lid rotator and transporter 45 to lift that lid, the lid raising process is initiated. Levelator cable cylinder 37 is activated and draws lifter frame 25 upward. As lifter frame 25 moves upward, prongs 27 encounter the bottom of the bottom lid of stack 11 and lift the entire stack upward. Stack of lids 11 is prevented from toppling over by the various guide bars and walls 18–21. Because for the lid rotator and transporter mechanism 45 explained below the top lid should be introduced at a centered location relative to mechanism 45 to ensure consistent lid placement, tilting or leaning of the stack is corrected by centering hoop 39, which is of sufficient diameter to even receive those lid stacks which tilt all the way into contact with one of the guide bars and walls 18–21. As the stack of lids 11, and necessarily the top lid, continues to be raised, the top lid is soon sensed by photosensors 43, 43'. Brake caliper 35, which is responsive to photosensors 43, 43', then engages braking bar 36 to halt the upward motion of lifter frame 25 and thereby brake the raising of stack of lids 11. It will be appreciated that when lid rotator and transporter 45 removes the top lid as explained more fully below, no lid will be sensed by photosensors 43, 43'. Therefore, the raising process restarts by disengaging brake caliper 35 and allowing cylinder 37 via lifter frame 25 to further raise or lift stack of lids 11 until photosensors 43, 43' again sense a new top lid at a proper height for lid rotator and transporter 45 and the raising is halted. This raising process continues until the original bottom lid of stack 11 is finally removed. When the lifter frame is then raised, pillow block 28 of lifter frame 25 is identified by proximity switch 41. Levelator cable cylinder 37 is then caused to reverse its direction of motion, and consequently lifter frame 25 is started downward. Simultaneously with this downward motion, stack straightener 21 returns to its retracted position. When lifter frame 25 reaches the bottom of levelator 17, frame 25 is identified by bottom mounted proximity switch 42 which leads to the restarting of the stack of lid introduction process and lid placement process described above.

Figure 3:
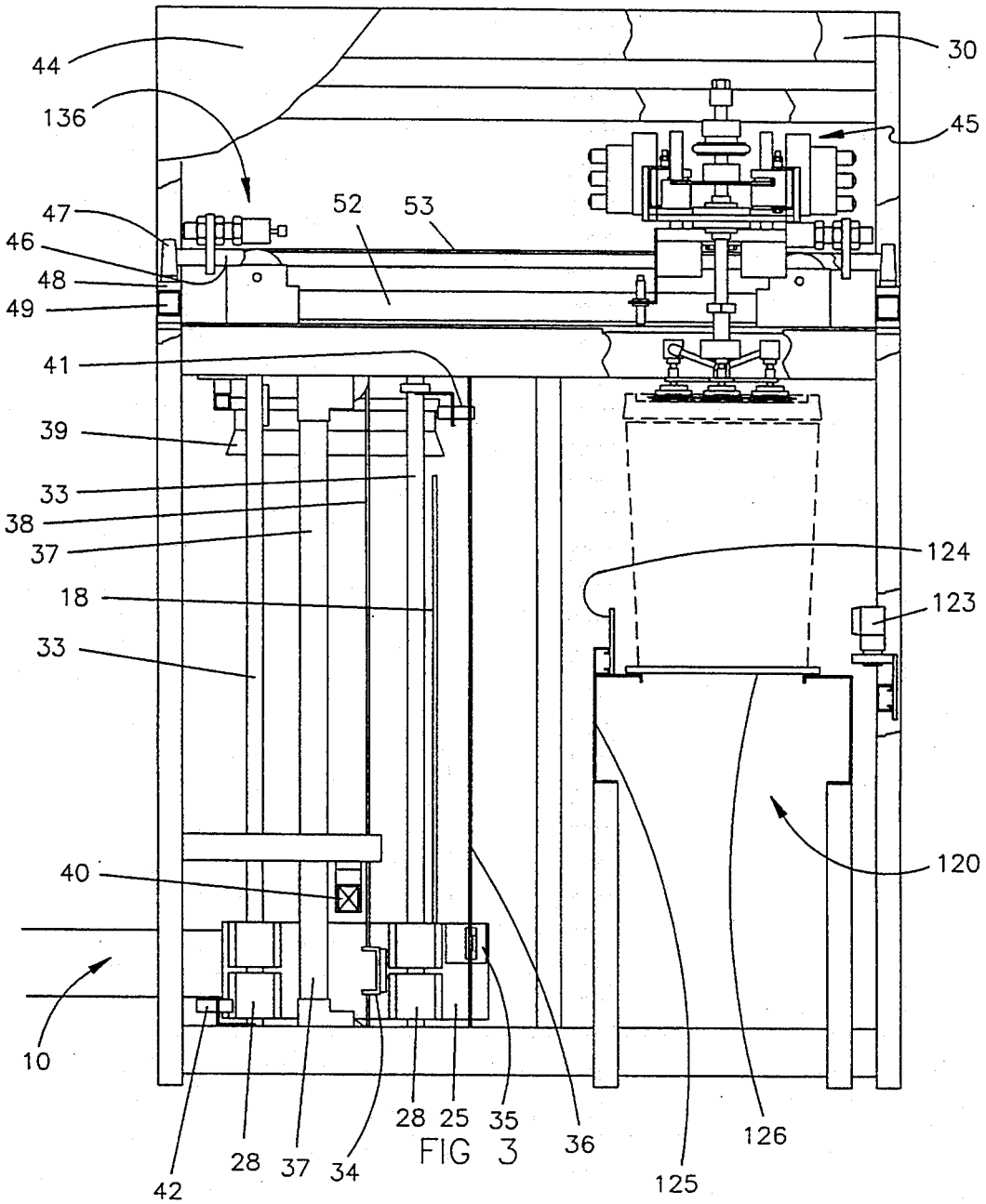
FIG. 3 shows a side view of the lid orienter and placer of FIG. 1 and the lid and bucket conveyers, wherein the lid rotator and transporter mechanism is located at the lid placement location and wherein portions of the device are removed for illustration purposes.
Figure 4:
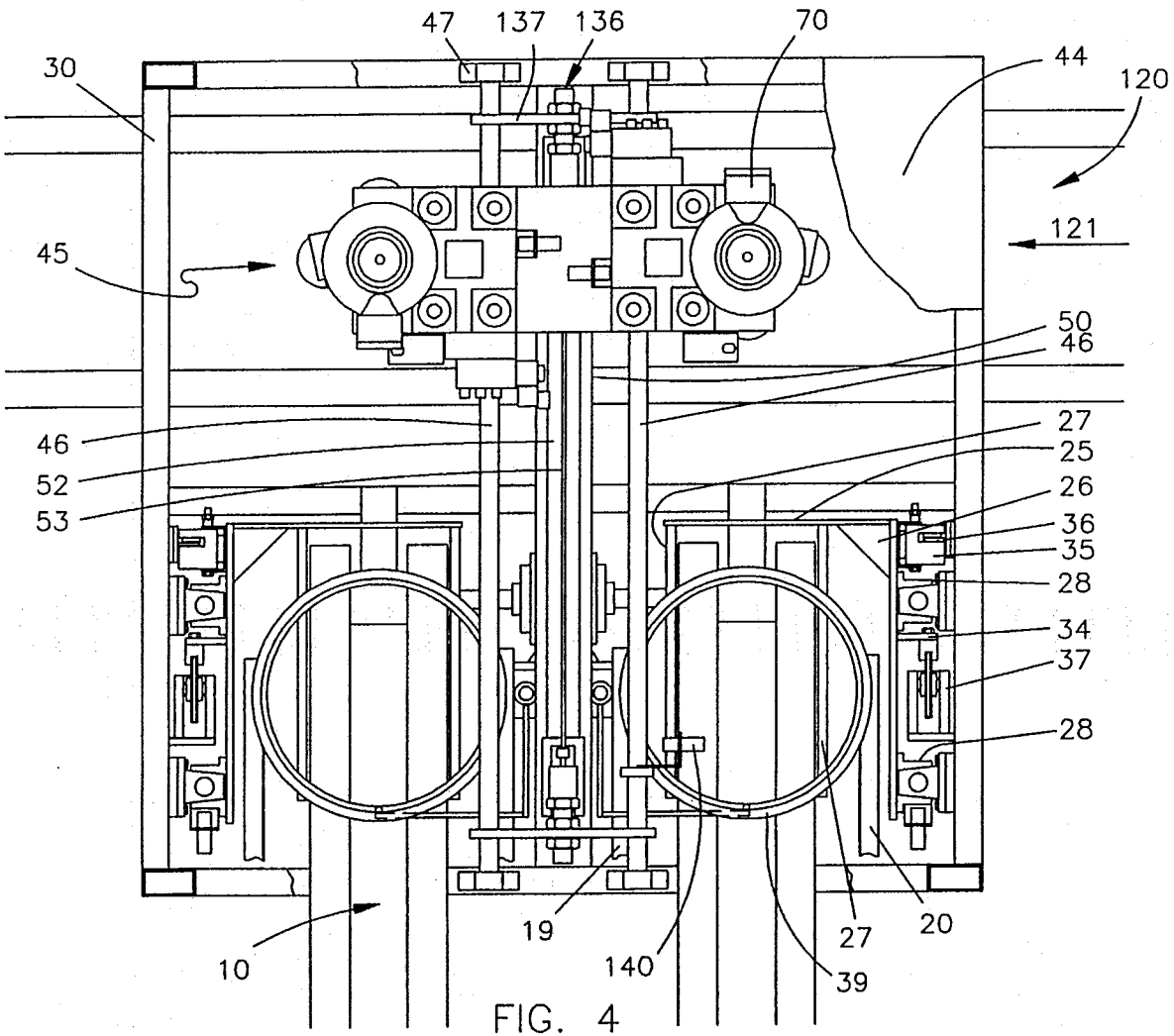
FIG. 4 shows a top view of the lid orienter and placer of FIG. 1, wherein portions of the device are removed for illustration purposes.
Figure 5:
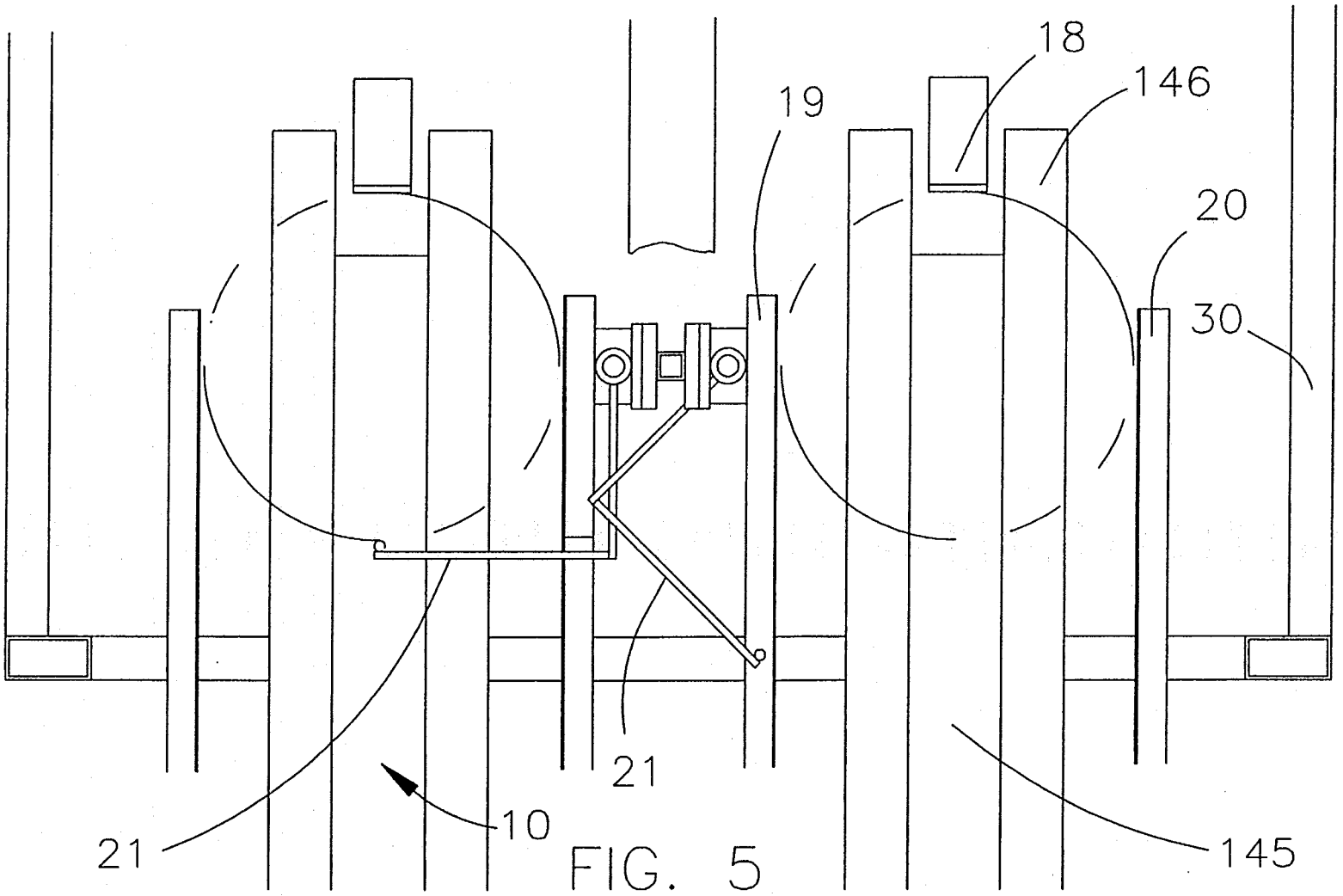
FIG. 5 shows a partial top view, as taken along line 5—5 in FIG. 2, of only the stack straighteners, wherein the left stack straightener is in the closed or operative position engaging a stack of lids (in shadow) on a lid conveyer and the right stack straightener is in the retracted or waiting position.
Figure 6:
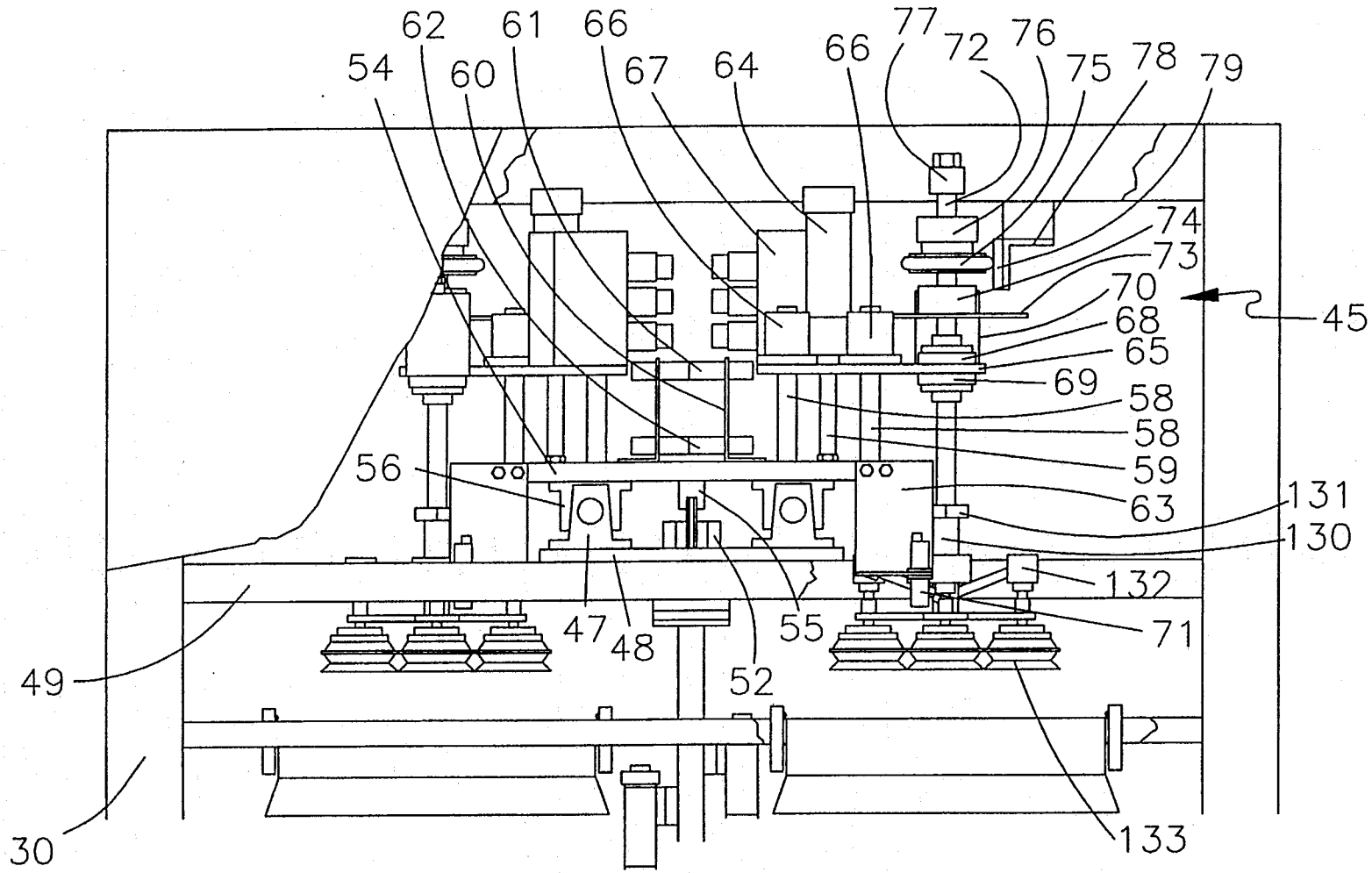
FIG. 6 shows an enlarged end view from FIG. 2 of the lid rotator and transporter mechanisms of the double lid orienter and placer of FIG. 1.

Referring now to FIGS. 3 and 4 and especially the enlarged view shown in FIG. 6, lid rotator and transporter 45 functions to lift a lid from the top of a stack of lids within levelator 17 and then rotationally orient that lid during the transporting of that lid from the raised stack to above bucket conveyer 120. Lid rotator and transporter 45 includes a pair of parallel support rods 46 which extend the entire length of lid placer 15. Each end of each support rod 46 includes a support bracket 47, which is rigidly attached with transverse bar 49 of support frame 30 through an intermediate reinforcing bar 48. To prevent jarring of the components on transfer plate 54 at the end of its horizontal travel, each end of lid placer 15 is equipped with one shock absorber assembly 136 mounted on a stop bar 137 connected to the pair of support rods 46. Mounted on one support rod 46 at the end above pail conveyer 120 is proximity switch 139 (not shown). Disposed at the other end of the same support rod 46 is another proximity switch 140. Attached to the underside of the opposing transverse bars 49, and consequently spanning the length of lid placer 15, is rectangular plate 50. Stationed on the top of plate 50 and secured thereto is cable cylinder 52, which provides for the reciprocating horizontal motion of lid rotator and transporter 45.

Slidably mounted on support rods 46 is transfer plate 54. Welded to the underside of plate 54 is cable attachment member 55, which is coupled with cables 53 of cable cylinder 52, as well as four pillow blocks 56, one disposed at each corner of plate 54. It will be appreciated that these pillow blocks slidably receive therethrough support rods 46. Attached to the topside of plate 54 are four vertical guide rods 58 for each placer, proximity switches bracket 60, and the distal end of shaft 59 of pneumatic raising cylinder 64. Mounted to the top end of proximity switches bracket 60 is laterally aligned proximity switch 61, and a similarly constructed and aligned proximity switch 62 is mounted at the lower end of bracket 60. An additional L-shape photoeye sensor bracket plate 63 is bolted to the side of transfer plate 54. A vertically disposed retroreflective photoeye sensor 71 is mounted on sensor bracket plate 63 and is aligned downwardly.

The actual vertical lifting and lowering of the lid to be placed is effectuated by pneumatic raising cylinder 64. The body of cylinder 64 is attached to lifting plate 65, which includes a hole that receives therethrough shaft 59. Vertical guide rods 58 are also received through holes in lifting plate 65. Attached to the topside of lifting plate 65 are four ball bushings 66 which each slidably receive a guide rod 58 therethrough, thereby minimizing frictional forces during the vertical moving of a lifted lid. Valve pack assembly 67, which is also attached to lifting plate 65, includes directional control valves for separately and selectively controlling pneumatic operation of raising cylinder 64, brake caliper assembly 70, and suction cups 133. The pneumatic hose connections between valve pack assembly 67 and these components are not shown.

Lifting plate 65 includes a cantilevered section with flanged bearings 68, 69 attached on either surface, as well as brake caliper assembly 70 attached to the top surface (see also FIG. 4). Hollow shaft 72, which passes through flanged bearings 68, 69 and plate 65, is free to rotate relative to lifting plate 65 but not free to move vertically relative to lifting plate 65. Brake disc 73 and brake hub 74 are fixedly secured to shaft 72 so as to be rotatable therewith, and brake disc 73 extends into brake caliper assembly 70 so as to be engagable thereby.

Positioned above hub 74 are the components which utilize the translation which occurs during the transporting of the lifted lid to provide the concurrent physical rotation of the lid for its rotational orienting. Orienting wheel 75 is coupled with slip clutch 76, and both axially receive hollow shaft 72. Orienting wheel 75, while receiving shaft 72 therethrough, does not directly mechanically engage shaft 72. Instead, orienting wheel 75 is rotationally secured to a portion of slip clutch 76 such that the rotation of wheel 75 is necessarily transferred to that portion of clutch 76, and a mating portion of slip clutch 76 is in direct mechanical engagement with shaft 72. Disposed lateral and adjacent to orienting wheel 75 is rail 78, which spans the length of lid placer 15 and is connected at either end to support frame 30. While rail 78 itself has clearance from orienting wheel 75, a support frame member, such as the attached shim portion 79 shown or alternatively a stepped portion of rail 78, is laterally positioned such that orienting wheel 75 contacts it and is in rolling engagement therewith. Shim portion 79 is of a length at least as great as the circumference of orienting wheel 75. As a result, wheel 75 can be forced to undergo an entire revolution during its rolling contact with shim 79.

Rotating pressure joint assembly 77 caps the top of hollow shaft 72. A pneumatic hose (not shown) connects between valve pack assembly 67 and rotating pressure joint assembly 77 to introduce air through hollow shaft 72 and into vacuum manifold 130. Rotating pressure joint assembly 77 is constructed to be airtight with hollow shaft 72 and to not rotate with shaft 72, thereby ensuring the pneumatic hose is not subject to repeated twisting.

Attached via collar 131 at the bottom of hollow shaft 72 is vacuum manifold 130. An 0-ring seal prevents air from escaping from the manifold. As best shown in FIG. 3, vacuum manifold 130 provides a means for mounting suction cups 133 and includes a venturi type vacuum pump 132 for each suction cup 133 employed. When air is passed through vacuum pumps 132, a sufficiently strong vacuum is created within suction cups 133 to allow a bucket lid to be held by suction cups 133 during lid lifting and placement. Four suction cups 133, disposed 90° apart, are preferably employed to lift a lid. It has been determined that one or two suction cups may be employed within the lifting mechanism. However, certain bucket lids have fittings or reinforcing ribs or other projections or recesses located around the bucket lid which prevent an adequate vacuum grip from being formed by a single or double suction cup assembly. However, with four suction cups 133, even if one cup 133 does not grip the lid, an adequate grip to provide a sufficient lifting force can still be achieved.

When a stack of lids is first introduced into levelator 17, and with directions in reference to FIG. 3, lid rotator and transporter mechanism 45 functions as follows. When levelator 17 stops raising a stack of lids when the top lid is identified by photosensors 43, 43', that top lid is positioned at a selected height appropriate for pickup. Lid rotator and transporter mechanism 45, with cylinder shaft 59 of raising cylinder 64 extended such that lifting plate 65 and therefore suction cups 133 are in a raised or first position, will be on the left side of lid placer 15. More specifically, at this time hollow shaft 72 will be centered over the top lid of the stack on levelator 17, or in other words will be collinear with the axis of centering hoop 39. Raising cylinder 64 will then be controlled by valve pack assembly 67 to retract shaft 59, causing lifting plate 65 to be lowered until proximity switch 62 identifies the plate and halts the lowering at a lower or second position. When the plate is so lowered, suction cups 133 are designed to then be in direct contact with the top lid of the stack. The elasticity of suction cups 133 account for any minor discrepancies between the actual and design height of the top lid of the raised stack. Valve pack assembly 67 then functions to create a vacuum in suction cups 133, which thereby grip or otherwise hold the top lid. Raising cylinder 64 will then be controlled by valve pack assembly 67 to extend shaft 59, causing lifting plate 65 to be raised. Due to the action of suction cups 133 and its linkage with plate 65, the top lid will simultaneously be vertically moved or lifted from the stack of lids. Plate 65 will be raised until proximity switch 61 identifies the plate and halts the raising at the first position. Cable cylinder 52 will then be pneumatically powered, as directed by a control valve (not shown), to begin transporting lifting plate 65 to the right, or toward the lid placement location above bucket conveyer 120. Initially during its transport to the right the lifted lid and shaft 72 will not be rotating but rather will merely be translating. This lack of rotation occurs because orienting wheel 75 has not reached shim portion 79. As the lid transportation continues and shaft 72 moves further to the right, orienting wheel 75 reaches and begins to roll against shim portion 79. As slip clutch 76 is secured with wheel 75, it also begins to rotate. Moreover, because at this point brake caliper assembly 70 is off or in other words is not clamping brake disc 73, shaft 72 and the lifted lid begin to rotate while the lid is transported, or in other words the lid rotation and transport occur concurrently. During the time the top lid is held by suction cups 133, photosensor 71, which is positioned above the lid, is operative. Photosensor 71 is designed to recognize or sense the fitting in the top surface of the lifted lid by sensing an elevation change in the lid surface. Other types of sensors positioned above the lid may also be feasible. For instance, a sensor may recognize a metal fitting by distinguishing it from the plastic bucket lid. Alternatively, if the fitting were to include an actual opening, the sensor could sense through the opening light reflected from a reflective device below the lid. For any of these types of sensors, no mechanical contact is required with the lid. Moreover, other types of sensors known to those skilled in the art, perhaps video cameras, infrared or magnetic, are not intended to be precluded from use, Thus, the sensor need not be placed immediately proximate the lid and can be placed at a location where it is less likely to interfere with suction cups 133.

As the lid continues to rotate, photosensor 71 continues to search for the lid fitting. Upon recognizing or sensing the fitting, the rotation of the lifted lid is halted. Specifically, in response to the sensing of photosensor 71, valve pack assembly 67 functions to activate brake caliper assembly 70, which clamps onto brake disc 73. As disc 73 is fixedly secured to shaft 72, stopping the rotation of brake disc 73 also stops the rotation of the lifted lid. Despite the stopping of the rotation of shaft 72, orienting wheel 75 continues its rolling engagement with shim 79 as slip clutch 76 allows for slippage relative to shaft 72. It will be appreciated that the use of shim 79 at least as long as the circumference of wheel 75 ensures that the lid fitting will pass beneath sensor 71, as the lifted lid will be rotated 360° if necessary. Of course, the actual angle through which the lid is rotated is unpredictable as it is a function of the lid's random orientation within the stack. For the placement of sensor 71 as shown, after the braking of shaft 72 and thereby the lifted lid, the fitting of the lid will situated to the far left. The unlidded buckets being conveyed on conveyer 120 will have been oriented such that the handle ends are each disposed in the line of the bucket travel path. Therefore, the placed lid will be oriented 90° from the handle ends. Of course, if a different lid rotational orientation is desired, several options are available which do not require that the buckets themselves be reoriented. For instance, sensor 71 could be moved to another location above the lifted lid. Or, as the rotational speed of the lifted lid is known as it is directly related to the controllable speed at which the lid is transported or moved from above levelator 17 to above bucket conveyer 120, brake caliper assembly 70 could simply be programmed to brake a selected or set time period after the lid fitting is sensed by sensor 71. In such a case, the fitting would have enough time to rotate into the desired location before the rotation of the lifted lid is stopped.

Although the lifted lid has thusly been rotationally oriented, it continues to be moved toward the lid placement location, or to the right. When lifting plate 65 reaches the end of support rods 46 and is sensed by proximity switch 139, cable cylinder 52 stops horizontally moving the lifted lid. Raising cylinder 64 then retracts shaft 59, causing lifting plate 65 to be lowered until proximity switch 62 identifies the plate and halts the lowering at the second position. At this time, lid rotator and transporter mechanism 45 is prepared for lid placement. The lifted lid, shown in shadow in FIG. 3, is suspended and centered directly over conveyer 120 with the lowest part of the lid, usually the lid skirt, preferably at a height less than an inch and even more preferably at a height of around a quarter of an inch above the top of the unlidded buckets, shown in shadow in FIG. 3, being conveyed on conveyer 120. If at another time other size buckets are to be used with lid placer 15, it is possible to adjust the height of conveyer 120 or vertically adjust proximity switch 62 an appropriate amount such that the distance the lid is dropped remains this small. When bucket sensing photoeye 123, which is mounted to support frame 30 and sights nonmoving reflector 124 mounted on a stationary edge of conveyer 120, identifies or senses a bucket on conveyor 120 and passing below the suspended lid, the vacuum in suction cups 133 is ceased as the cups are operably connected to photosensor 123. Suction cups 133 then function to release the lid such that the rotationally oriented lid vertically drops a very short distance to be placed onto the bucket top. Simultaneous with the vacuum loss, suction cups 133, by way of controlling raising cylinder 64 as described above, will began to be raised toward their first position. This raising is necessary as most types of lids have an upper circumferential edge which is higher than the more center region where the suction cups 133 grip, and therefore unless suction cups 133 are raised they would not clear the lid edge as the lid is conveyed on top of the bucket from underneath the suction cups. Of course, the lids could be dropped from a higher location relative to the passing bucket and there would be no need to raise the suction cups 133. However, as the distance the lid is dropped increases, the likelihood the rotational orientation of the lid will be comprised is also undesirably increased.

Suction cups 133 are continued to be raised until the first position is reached, namely when lifting plate 65 is identified by proximity switch 61. Cable cylinder 52 is then powered to begin transporting lifting plate 65 to the left, or toward the lid lifting location above levelator 17. When lifting plate 65 reaches the left end of support rods 46 and is sensed by proximity switch 140, cable cylinder 52 stops horizontally moving the unit and shaft 72 is again centered over centering hoop 39. During the time lid rotator and transporter 45 was placing the previous lid, levelator 17 was elevating the stack to a new top lid to the proper height to be received by lid rotator and transporter 45. Therefore, suction cups 133 can be immediately lowered down to lift up the top lid and repeat the placement process described above.

It will be appreciated that in order to drop and thereby place a suspended lid precisely on the top of a moving bucket, the timing sequence must be reviewed and refined. For example, horizontal shifting of sensing photoeye 123 and reflector 124 can account for conveyer speed or distance the lid is being dropped. It will also be appreciated that with a double lid placer, in order to ensure dual lid placement the lid rotator and transporter 45 will not reciprocate horizontally until both sets of suction cups 133 have completed lifting separate lids or completed placing the lids on separate buckets. In addition, lid rotator and transporter 45 is designed in conjunction with conveyer 120 so as to transport lids fast enough to place lids on all the buckets passing under lid placer 15. However, if for unexpected reasons a bucket passes under lid placer 15 prior to the time a lid is ready to be placed on the bucket, for example perhaps only one levelator introduced a lid to a double lid placer so lid rotator and transporter 45 is waiting for another lid, conveyer 120 can be stopped. As conveyer stoppage can cause the bucket contents to spill, it is highly undesirable and care is used in designing the system to ensure it happens infrequently.

Figure 7:
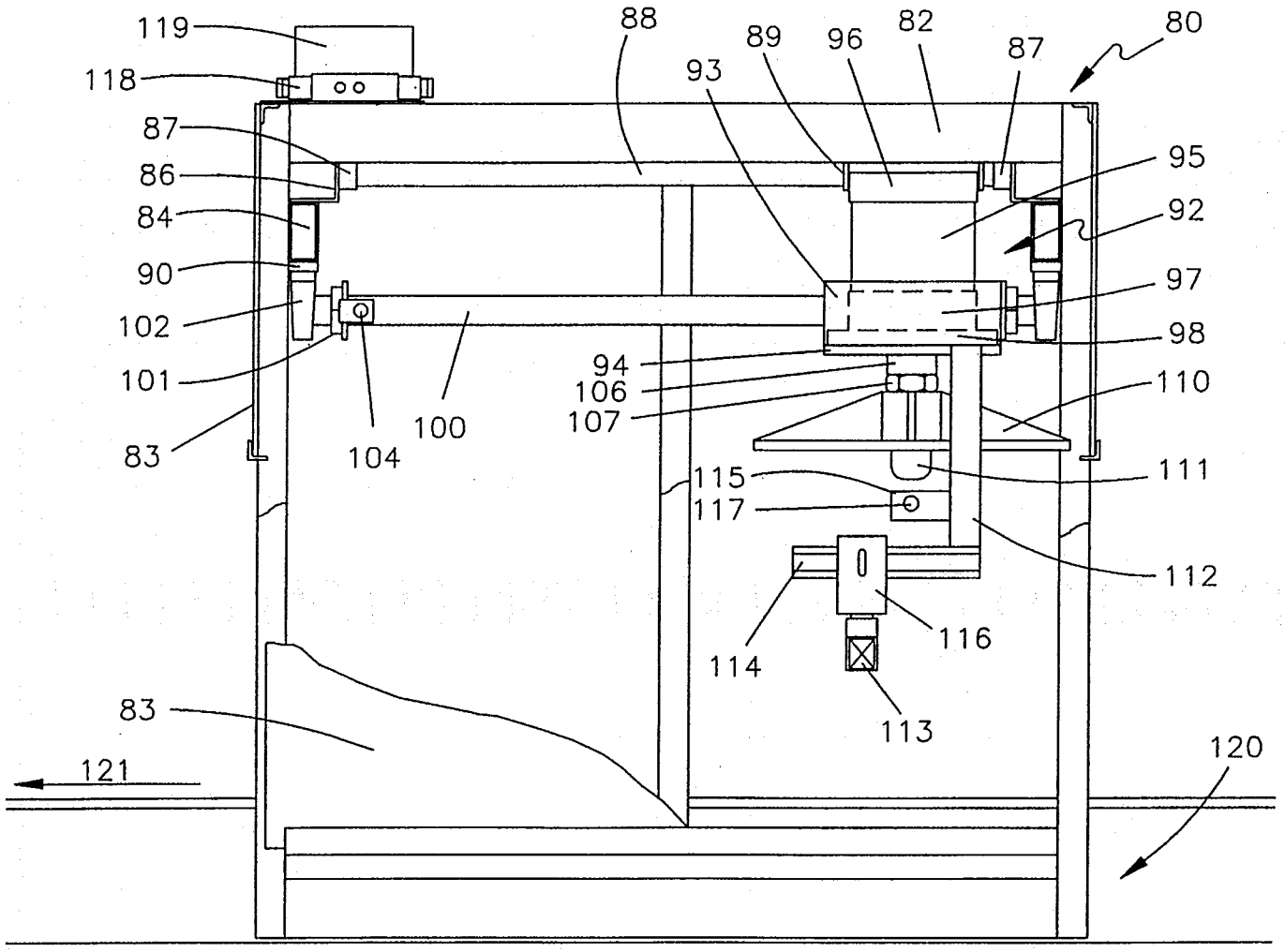
FIG. 7 shows a side view of the traveling lid press of FIG. 1, wherein the protective cover and support frame have been partly removed for illustration purposes.
Figure 8:
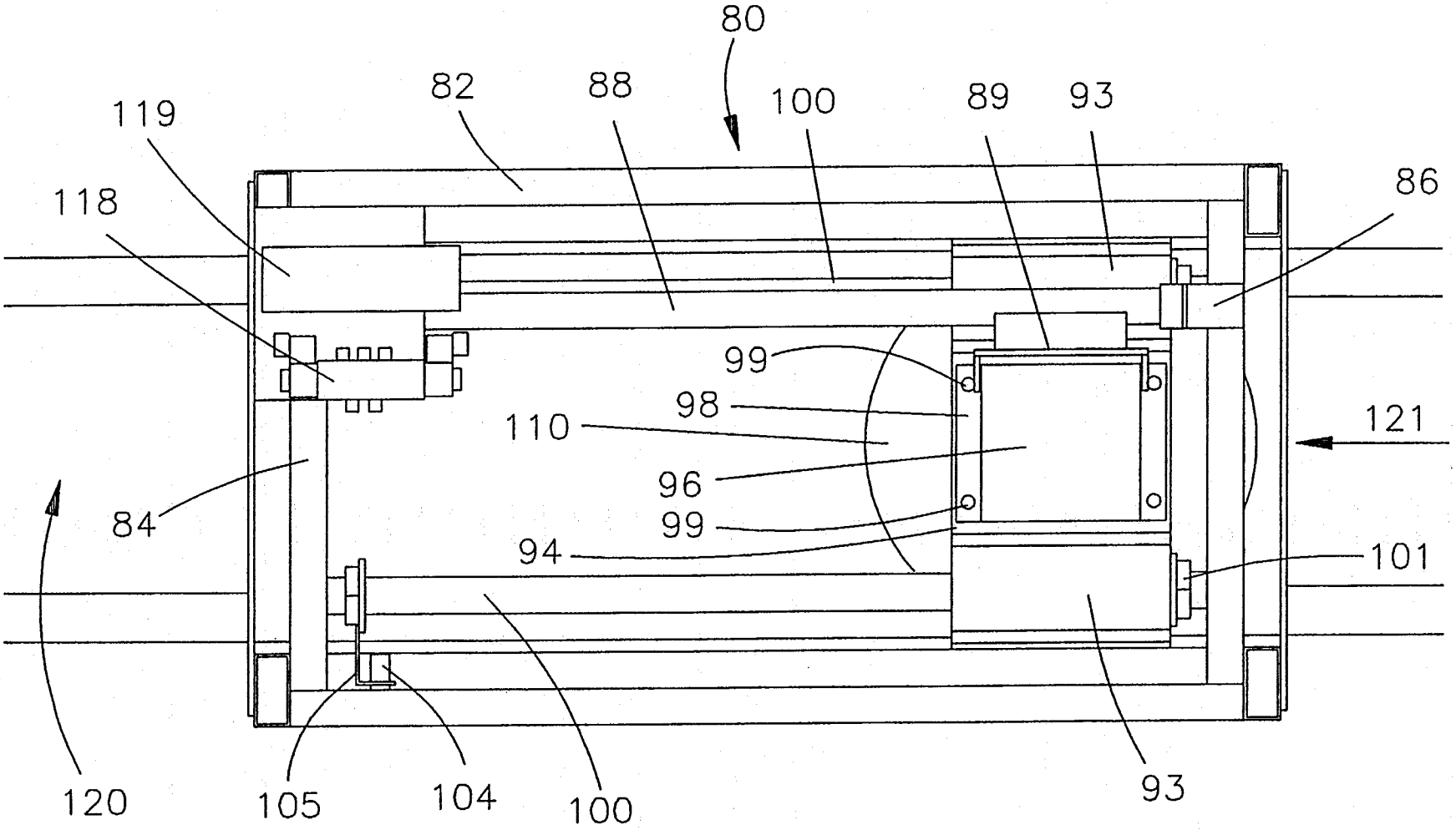
FIG. 8 shows a top view of the traveling lid press of FIG. 7.

Referring now to the side view shown in FIG. 7 as well as the top view in FIG. 8, traveling lid press 80 is shown with bucket conveyer 120 passing therethrough. Lid press 80 has a parallelepiped support structure 82 preferably constructed from rectangular hollow steel bars. To prevent accidental injury to an operator, plexiglass shield 83 is provided. Except for an opening at each end where the buckets on conveyer 120 respectively enter and exit lid press 80, shield 83 covers the areas between the support structure bars on the unit ends and sides.

A pneumatic transfer cylinder 88 provides for the horizontal movement of lid press plate 110 of traveling lid press 80 and is connected with support structure 82. At each end of support structure 82, a tubular cross member 84 which horizontally spans the width of lid press 80 is connected thereto. Bolted to the top edge of each cross member 84 is an L-shaped cylinder mounting bracket 86. The end caps 87 of pneumatic transfer cylinder 88 are attached to one of the opposing mounting brackets 86, thereby suspending pneumatic transfer cylinder 88 across substantially the entire length of lid press 80. Transfer bracket 89 extends laterally from and connects to the internal piston of transfer cylinder 88. As is known in the art, selective pressurization of transfer cylinder 88 can accurately move bracket 89 along the entire length of cylinder 88. Transfer bracket 89 includes a C-shaped region (as shown in FIG. 8) which straddles or accommodates the width of top end cap 96 of pneumatic press cylinder 95, thereby coupling transfer cylinder 88 with pneumatic cylinder 95 to effect the reciprocating horizontal motion of both press plate 110 and cylinder 95.

A pair of parallel and identical guide rods 100 are each separately coupled with the facing cross members 84 via stop collars 101, shaft supports 102, and support pieces 90. Each support piece 90 is welded to the underside of its cross member 84 to provide an additional thickness to more securely receive the bolts which connect the four separate shaft supports 102 with cross members 84. As best shown in FIG. 8, metal proximity switch 104 is attached via L-shaped bracket 105 to the stop collar 101 on one of the guide rods 100, and provides a fail safe carriage stoppage command signal as described more fully below.

Carriage 92, which is slidably mounted to guide rods 100, supports the mechanism for vertically shifting press plate 110. Carriage 92 includes a pair of pillow blocks 93 which each have an axially bore therethrough sized to slidably receive a guide rod 100. A rigid carriage plate 94, having a shaft receiving opening disposed at its center, is securely connected to each pillow block 93 in a rigid or non-sliding fashion. The casing of pneumatic press cylinder 95 includes a square cross-sectioned top end cap 96 and a similarly shaped bottom end cap 97 with a mounting flange 98. Four bolts or fasteners 99 connect flange 98, and therefore pneumatic cylinder 95, to carriage plate 94. Inserted through the central opening in plate 94 is piston shaft 106 of pneumatic cylinder 95. Shaft 106 is externally threaded at its lower end and screws into jamb nut 107 as well as the upward extension of press plate 110, thereby coupling shaft 106 to press plate 110. After coupling together press plate 110 and shaft 106, jamb nut 107 is tightened down to lock press plate 110 in place. A burping button 111 is positioned on the bottom, flat round surface of press plate 110. Burping button 111, which can be screwed off plate 110 if not needed, functions to contact the center of the lid being seated to force out air within the bucket before the complete seating occurs.

Welded to the side edge of carriage 92, and positioned to the side of press plate 110, is vertical leg 112 of a sensor mounting bracket. Two horizontal legs 114, 115 are rigidly attached to leg 112. Disposed within a vertical slot in leg 115 is proximity switch 117. The vertical slot allows the position of switch 117 to be slightly altered vertically and thereby be adjusted for use with different sized buckets. Photoeye sensor 113 is mounted on photoeye bracket 116. A unistrut type construction of leg 114 and its engagement with photoeye bracket 116 allows bracket 116 to be horizontally moved and secured along any portion of leg 114 by operation of a single nut and bolt mechanism used in conjunction with the unistrut construction, thereby allowing sensor 113 to be placed where desired relative to press plate 110.

Positioned atop support structure 82 are a pair of two position directional control valves 118, 119. Valves 118, 119 respectively selectively direct the high air pressure to the appropriate ports of the pneumatic transfer cylinder 88 and pneumatic press cylinder 95 to provide for the motion of lid press plate 110 in the desired manner. The electrical and pneumatic connections between valves 118, 119 and their electric control and air pressure sources, as well as the pneumatic connections or hoses between valves 118, 119 and transfer cylinder 88 and pneumatic press cylinder 95 are not shown.

In operation, traveling lid press 80 functions as follows. A bucket having a lid placed loosely thereon by lid placer 15 is introduced, from the right in FIG. 7, into traveling lid press 80 by conveyer 120. As the bucket proceeds or continues to be conveyed along conveyer 120 in the direction indicated by arrow 121, the bucket passes and breaks the beam of light emitted by photoeye sensor 113, which is operatively coupled with transfer cylinder 88 and pneumatic press cylinder 95 such that the cylinders are responsive to the information sensed by sensor 113. Upon the sensing of the bucket by photoeye sensor 113, valve 118 functions to activate transfer cylinder 88, which begins to move transfer bracket 89 with the bucket. In other words, and due to the engineering design, transfer bracket 89 begins to move at approximately, and preferably exactly, the same speed and in the same direction as the moving bucket. By means of its straddling of end cap 96, transfer bracket 89 transfers its horizontal motion to pneumatic cylinder 95 and therefore to lid press plate 110. Concurrently with the horizontal movement achieved by transfer cylinder 88, pneumatic cylinder 95 is activated by valve 119. Pneumatic press cylinder 95 extends shaft 106 and thereby forcibly moves lid press plate 110 downward from the height above the lid of the conveyed bucket at which lid press plate 110 and burping button 111 are maintained when not in motion. As press plate 110 moves downward, it eventually contacts the bucket lid. Sensor 113 is aligned along bracket 114 such that press plate 110 will be centered over the bucket and lid when contact occurs. Pneumatic cylinder 95 provides a significant amount of force, such as in excess of 1,000 lbs of force and preferably in the range of 1,500 lbs of force, to drive press plate 110 downward. As a result, press plate 110 applies sufficient pressure to the lid and bucket assembly to thereby properly seat the lid onto the bucket. The extent of the downward extension of the piston shaft, and thereby the completion of the seating function, is regulated by proximity switch 117. Switch 117 is positioned at a height above conveyer 120 at which lid press plate 110 will be located after lowering sufficiently down to properly seat the bucket lid. When proximity switch 117 identifies lid press plate 110, the seating process stops and preparations for seating the next bucket introduced into lid press 80 commences. Specifically, control valve 118 directs pneumatic transfer cylinder 88 to be pressurized such that the direction of motion of transfer bracket 89 is reversed. Consequently, lid press plate 110 horizontally translates upstream along its path above bucket conveyer 120, or in other words returns to its waiting position by moving in a direction opposite the travel direction of bucket conveyer 120. Simultaneous with this horizontal return of lid press plate 110, pneumatic press cylinder 95 retracts piston shaft 106 to raise press plate 110. As press plate 110 is being returned to its waiting position, sensor 113 is continuously active. If another bucket is not sensed by photoeye sensor 113, carriage 92 will translate all the way to its waiting location proximate stop collars 101 which are on the upstream side of lid press 80 (the right side of FIG. 7). However, if during the return of carriage 92 another bucket is introduced to lid press 80 and sensed by sensor 113, the seating process or sequence will instantly initiate. Specifically, transfer cylinder 88 will reverse its course to again move in the direction of conveyer 120 and pneumatic press cylinder 95 will drive press plate 110 downward to seat the lid loosely placed on the introduced bucket.

In the event buckets are introduced too rapidly for the lid press 80, a fail safe device in the form of proximity switch 104 is provided in lid press 80. If carriage 92 moves far enough along bucket conveyer 120 to trip proximity switch 104, a command signal will be sent to halt the movement of carriage 92. It will be appreciated that should this halting occur, then the lid on the bucket which was being pressed downward has not quite been seated properly. Therefore, activation of proximity switch 104 will preferably also halt for but a short time the motion of conveyer 120 such that the lid seating can be completed, and then conveyer 120 will be restarted and press plate 110 will return to its waiting position.

As is evident from the foregoing disclosure, the present bucket lidding system provides a number of advantages. For instance, because after being rotationally oriented a lid is placed onto a continuously moving bucket by being vertically dropped only a small distance, the likelihood that the lid orientation is maintained during placement is large. As the fitting sensing device of the present invention which allows for lid orientation is situated above the lid to be placed and functions without mechanically contacting the lid, the sensing device does not repeatedly have to be moved into and out of operating position and the possibility of mechanical failures or fatigue are reduced. The capability of the present invention to remove a lid from the top of a stack of lids for placement on a passing bucket is also advantageous. Separate and loader friendly sized stacks of lids can be introduced to the bucket lidding system at ground level and with but limited machinery. In addition, because the bucket lidding system of the present invention seats lids on buckets being continuously conveyed on a conveyer device, the probability of spills is reduced. Moreover, the capability of the instant bucket lidding system to apply a significant amount of downward force to a bucket lid means that even UN specification type lids can be seated by the present invention without requiring the bucket be stopped for the lid seating.

What is claimed is:

1. A bucket lidding system for buckets having an upper lip, the system comprising:

conveyer means for moving a bucket with an unseated lid thereon with the lid substantially contacting the entire upper lip of the bucket, said conveyer means defining a bucket travel path and a bucket travel speed, said conveyer means moving the bucket in a first direction along the travel path;

a lid press plate; and means for moving the lid press plate in the first direction along the bucket travel path at a speed approximately equal to the bucket travel speed during lid seating and means for moving the lid press plate downward from a height above the unseated bucket lid to thereby seat the lid on the bucket.

2. The bucket lidding system of claim 1 wherein the lid press plate first direction moving means is structured to move the lid press plate along the bucket travel path in a direction opposite the first direction after seating the lid.

3. The bucket lidding system of claim 2 wherein the lid press plate downward moving means comprises a press cylinder, and wherein the lid press plate first direction moving means comprises both a transfer cylinder and a means for coupling the transfer cylinder to the press cylinder.

4. The bucket lidding system of claim 2 further comprising means for sensing a passing bucket on the conveyer means, the lid press plate downward moving means being responsive to the bucket sensing means.

5. The bucket lidding system of claim 2 wherein the lid press plate downward moving means drives the lid press plate downward with a force in excess of 1,000 lbs.

6. A bucket lidding system comprising:

conveyer means for moving a lidless bucket;

means for lifting a top lid from a stack of bucket lids;

means for transporting the lifted lid to a position over the conveyer means; and means for sensing the bucket on the conveyer means, the sensing means being operably connected to the means for releasing the lifted lid to thereby place the lid onto the bucket.

7. The bucket lidding system of claim 6 further comprising means for raising the stack of bucket lids such that the top lid is positioned at a selected height.

8. The bucket lidding system of claim 7 wherein the bucket stack raising means comprises a photosensor for sensing the top lid and a means for braking the raising of the stack, the means for braking the raising of the stack being responsive to the photosensor.

9. The bucket lidding system of claim 7 further comprising a cable cylinder for powering the raising of the stack.

10. The bucket lidding system of claim 7 further comprising a stack straightener and a stack centering hoop.

11. The bucket lidding system of claim 6 further comprising means for rotating the lifted lid prior to releasing the lid, means for sensing a fitting in the lifted lid, and means responsive to the lid fitting sensing means for stopping rotation of the lifted lid.

12. The bucket lidding system of claim 11 wherein the lid rotation and transport occur concurrently.

13. A bucket lidding system for placing a lid having a fitting onto a bucket, the system comprising:

means for holding and releasing the lid;

means for rotating the held lid prior to releasing the lid;

means for sensing the lid fitting without mechanically contacting the lid; and means responsive to the sensing means for stopping rotation of the held lid in a radially oriented position, such that the lid holding and releasing means releases the lid onto the bucket directly from the radially oriented position.

14. The bucket lidding system of claim 13 wherein the lid fitting sensing means comprises a photosensor.

15. The bucket lidding system of claim 13 wherein the lid fitting sensing means is positioned above the held lid.

16. The bucket lidding system of claim 13 wherein the lid holding and releasing means comprises a suction means.

17. The bucket lidding system of claim 16 wherein the suction means is rotatable and comprises at least one suction cup.

18. The bucket lidding system of claim 13 wherein the means for stopping rotation of the held lid is programmed to stop lid rotation a selected time period after the lid fitting sensing means senses the lid fitting.

19. The bucket lidding system of claim 13 further comprising means for lifting the lid from a top of a stack of lids.

20. The bucket lidding system of claim 13 further comprising means for sensing a bucket, the bucket sensing means being operably connected to the means for releasing the held lid to thereby place the lid onto the bucket.

21. The bucket lidding system of claim 13 further comprising means for transporting the held lid to a position over a conveyer means moving a lidless bucket, wherein the lid rotation and transport occur concurrently.

22. A bucket lidding system for placing a lid comprising:

means for holding the lid, the lid holding means comprising at least one suction means;

means for concurrently rotating and transporting the lid held by the holding means; and means for releasing the lid from the holding means onto a bucket.

23. The bucket lidding system of claim 22 wherein the at least one suction means comprises a plurality of suction cups.

24. The bucket lidding system of claim 22 wherein the lid includes a fitting, and further comprising means for sensing the lid fitting.

25. The bucket lidding system of claim 24 wherein the lid fitting sensing means senses the fitting without mechanically contacting the lid.

26. The bucket lidding system of claim 22 wherein the holding means is vertically movable to lift the lid from a top of a stack of lids.

27. The bucket lidding system of claim 26 further comprising means for raising the stack of bucket lids such that the top lid is positioned at a selected height.

28. The bucket lidding system of claim 22 further comprising means for sensing a bucket, the bucket sensing means being operably connected to the means for releasing the held lid to thereby place the lid onto the bucket.

29. The bucket lidding system of claim 22 wherein the lid includes a fitting, wherein the lid rotating and transporting means comprises a wheel in rolling engagement with a support frame member and in slip clutch engagement with the lid holding means, and wherein the lid holding means further comprises means for sensing the lid fitting and means responsive to the lid sensing means for stopping rotation of the held lid.

30. The bucket lidding system of claim 22 further comprising means for lifting the lid from a top of a stack of lids.

31. A bucket lidding system comprising:

conveyer means for selectively moving a vertical stack of bucket lids, the lids in the stack each having a fitting;

conveyer means for moving a lidless bucket;

means for raising from the lid stack conveyor means the entire stack of bucket lids such that a top lid of the stack is positioned at a selected height;

means for lifting and holding the top lid from the raised stack of bucket lids;

means for concurrently rotating the held lid and transporting the held lid to a position over the lidless bucket conveyer means;

means for sensing the lid fitting of the rotating held lid;

means responsive to the lid fitting sensing means for stopping rotation of the held lid whereby the lid has a selected rotational orientation with respect to the bucket on the lidless bucket conveyer means;

means for releasing the lid from the holding means; and means for sensing the bucket on the lidless bucket conveyer means, the bucket sensing means being operably connected to the lid releasing means to thereby place the lid onto the conveying bucket.

* * * * *